US005274848A

United States Patent [19]

Shamblin

[11] Patent Number: 5,274,848

[45] Date of Patent: Jan. 4, 1994

[54] CAMOUFLAGE SYSTEM

[76] Inventor: Robert L. Shamblin, 107 Cavalier Dr., Grafton, Va. 23692

[21] Appl. No.: 853,652

[22] Filed: Mar. 19, 1992

[51] Int. Cl.[5] ..... A41D 3/00

[52] U.S. Cl. ..... 2/69; 2/94; 428/919

[58] Field of Search ..... 2/69, 94, 244; 428/17, 428/21, 24, 26, 115, 919

[56] References Cited

U.S. PATENT DOCUMENTS

| | | | |
|---|---|---|---|
| 2,351,142 | 6/1944 | Mitchell | 428/919 |
| 4,106,124 | 8/1978 | Green | 428/919 |
| 4,243,709 | 1/1981 | Morton | 428/17 |
| 4,285,068 | 8/1981 | Ross | 428/919 |
| 4,517,230 | 5/1985 | Crawford | 2/94 |
| 5,010,589 | 4/1991 | Hamilton | 2/94 |

*Primary Examiner*—Clifford D. Crowder
*Assistant Examiner*—Diana L. Biefeld
*Attorney, Agent, or Firm*—Michael I. Kroll

[57] ABSTRACT

An improved camouflage system is provided which consists of a garment worn by a person, and a structure is for producing an effective camouflage. A mechanism is for attaching the camouflage structure in slightly overlapping rows to the garment for concealment of a body part of the person wearing the garment which will create the illusion of trees, shrubs and other foliage in a three dimensional effect to blend into the terrain environment.

7 Claims, 2 Drawing Sheets

CAMOUFLAGE SYSTEM

BACKGROUND OF THE INVENTION

1. Field of the Invention

The instant invention relates generally to disruptive pattern materials and more specifically it relates to an improved camouflage system.

2. Description of the Prior Art

Numerous disruptive pattern materials have been provided in prior art that are adapted to include different colors and shades to blend into various types of terrains, so as to render the materials less easily distinguished by the eye when viewed against a background of natural foliage and the like. While these units may be suitable for the particular purpose to which they address, they would not be as suitable for the purposes of the present invention as heretofore described.

SUMMARY OF THE INVENTION

A primary object of the present invention is to provide an improved camouflage system that will overcome the shortcomings of the prior art devices.

Another object is to provide an improved camouflage system for a hat, shirt and pants in which burlap strips are sewn onto the hat and attached to the shirt and pants by snap fasteners to give the appearance of foliage thereby indicating an excellent, effective camouflage.

An additional object is to provide an improved camouflage system in which the burlap strips are dyed in various shades of green, brown and other woodland colors for blending into woodland and grassy type environments, to indicate a stringy, fuzzy appearance which resembles Spanish moss.

A further object is to provide an improved camouflage system that is simple and easy to use.

A still further object is to provide an improved camouflage system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
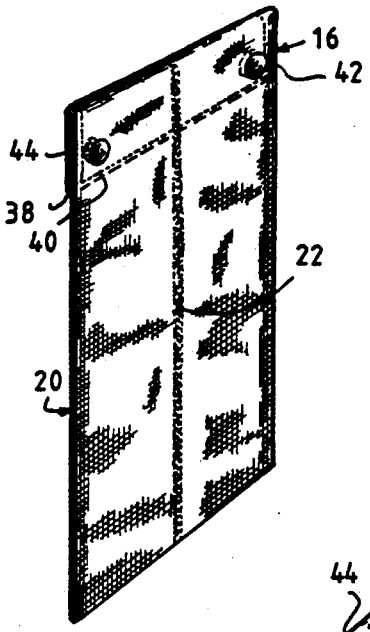
FIG. 1 is a perspective view of one burlap strip with its respective male snap fasteners attached thereto.
Figure 2:
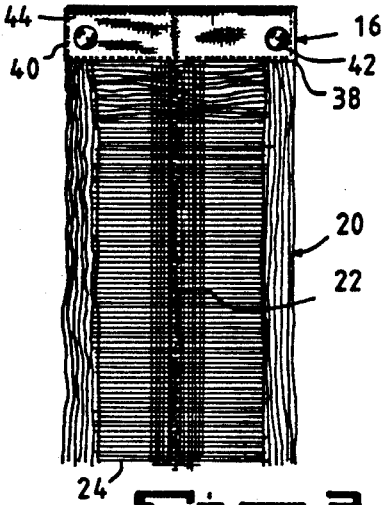
FIG. 2 is a front view of the burlap strip shown after fraying.

Turning now descriptively to the drawings, in which similar reference characters denote similar elements throughout the several views, the Figures illustrate an improved camouflage system 10, which consists of a garment 12 worn by a person and a structure 14 for producing an effective camouflage. A mechanism 16 is for attaching the camouflage structure 14 in slightly overlapping rows to the garment 12 for concealment of a body part of the person wearing the garment 12, which will create the illusion of trees, shrubs and other foliage in a three dimensional effect to blend into the terrain environment 18.

The camouflage structure 14 includes a plurality of burlap strips 20, wherein each said burlap strip 20 is sewn vertically down the center with a serging stitch 22. The individual strands 24 of the burlap strip are frayed until they nearly meet the serging stitch 22.

Figure 3:
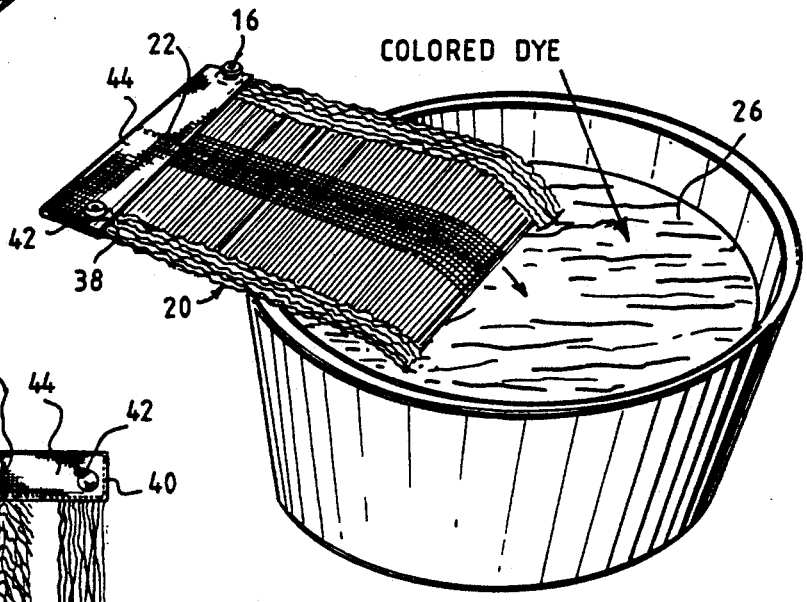
FIG. 3 is a perspective view of the frayed burlap strip being inserted into a colored dye.
Figure 4:
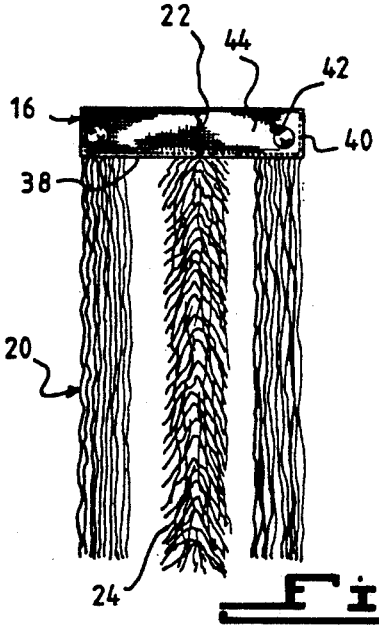
FIG. 4 is a front view of the burlap strip having the fuzzy appearance which resembles Spanish moss.

As shown in FIGS. 3 and 4, each burlap strip 20 is dyed with a colored dye 26 to various shades of woodland colors, so as to blend into woodland and grassy type environments. Each burlap strip 20 is wrung out by hand and allowed to air dry, so that the result is a stringy, fuzzy appearance for the burlap strip 20 which resembles Spanish moss.

Figure 7:
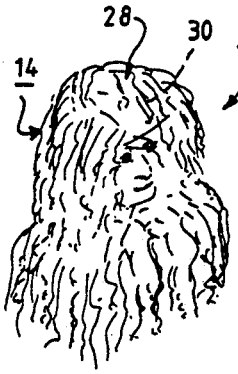
FIG. 7 is a perspective view of the hat with the burlap strips attached thereto worn on a person's head.
Figure 8:
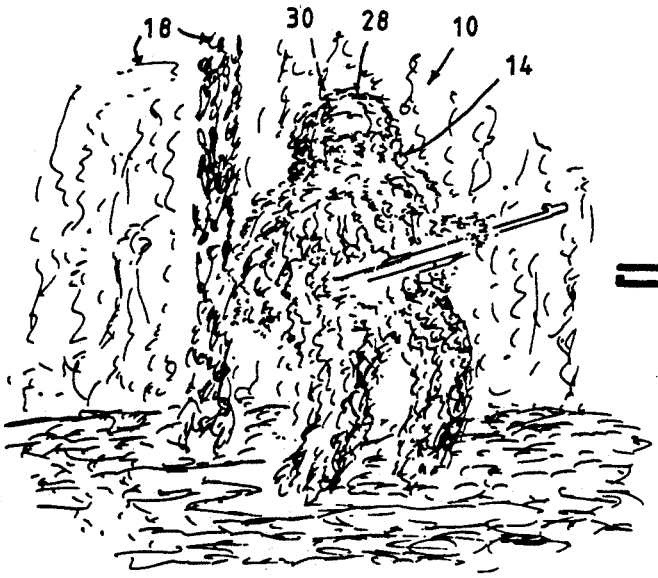
FIG. 8 is a perspective view of the complete invention shown being used to blend into the terrain.

As shown in FIGS. 7 and 8, the garment 12 is a hat 28 worn on the head of the person. The attaching mechanism 16 includes stitching 30 at the top of each burlap strip 20, so that said burlap strips 20 can be sewn directly onto the hat 28.

Figure 5:
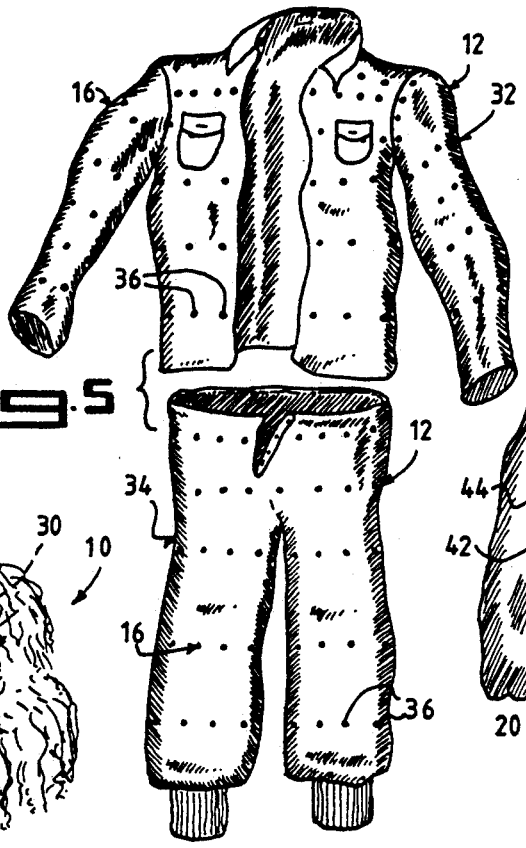
FIG. 5 is a perspective view of the shirt and pants having the female snap fasteners and before attachment of the burlap strips.
Figure 6:
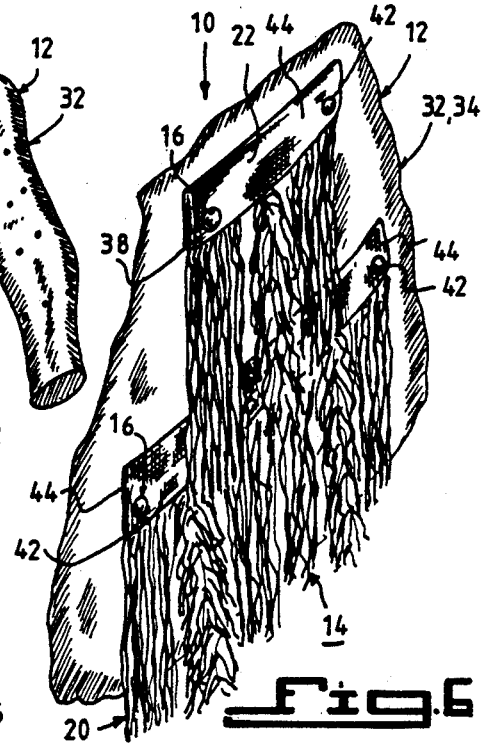
FIG. 6 is a perspective view of a portion of the shirt or pants showing the overlapping attachment of the burlap strips thereto.

As shown in FIG. 5, the garment 12 is a shirt 32 and pants 34 worn on the body of the person. The attaching mechanism 16 includes the shirt 32 and the pants 34 having a plurality of random placed female snap fasteners 36 attached thereto. Each burlap strip 20 is folded over at a top end 38 and sewn in place with a straight stitch 40 for added strength. A pair of spaced male snap fasteners 42 are attached to the fold portion 44 of the burlap strip 20, so as to be removably affixed to two of the female snap fasteners 36 on the shirt 32 and pants 34 for allowing the person to change the color of the burlap strips 20 to accommodate seasonal and terrain changes. This also allows the person to remove the burlap strips 20, so that the shirt 32 and pants 34 can be washed without damaging the burlap strips 20.

To fabricate the improved camouflage system 10 for the hat 28, the following steps should be taken:

1. Cut a piece of burlap material into the burlap strips 20 of various lengths.
2. Sew the center of each burlap strip 20 vertically with the serging stitch 22.
3. Fray the individual strands 24 of each burlap strip 20 until they nearly meet the serging stitch 22.
4. Dye the burlap strips 20 to the various shades of color.
5. Wring out by hand the burlap strips 20 and allow them to air dry.
6. Sew the burlap strips 20 by stitching 30 directly to the hat 28 in the slightly overlapping rows.

To fabricate the improved camouflage system 10 for the shirt 32 and the pants 34 the following steps should be taken.

1. Cut a piece of burlap material into the burlap strips 20 of various lengths.

2. Sew the center of each burlap strip 20 vertically with the serging stitch 22.
3. Fray the individual strands 24 of each burlap strip 20 until they nearly meet the serging stitch 22.
4. Fold over the top end 38 of each burlap strip 20 and sew in place with the straight stitch 40.
5. Attach the pair of spaced male snap fasteners 42 to the fold portion 44 of each burlap strip 20.
6. Dye the burlap strip 20 to the various shades of color.
7. Wring out by hand the burlap strips 20 and allow them to air dry.
8. Attach the plurality of female snap fasteners 36 randomly to the shirt 32 and the pants 34.
9. Removably affix the two male snap fasteners 42 of each burlap strip 20 to the shirt 32 and the pants 34.

Each burlap strip 20 can be typically, but not limited to four and a half inches in width and at various lengths. The fold portion 44 can be approximately one and a quarter inches long. Each burlap strip 20 can be dyed in various shades of green, brown and other woodland colors to blend into the terrain environment 18.

The advantage of the improved camouflage system 10 is a camouflage outfit which provides maximum concealment of body parts and creates the illusion of trees, shrubs and other foliage Unlike other camouflage outfits which simply use various patterns to produce a three dimensional effect to blend into the environment, the improved camouflage system 10 uses the burlap strips 20 to provide a true three dimensional camouflage which not only blends into the woodland environment, but actually looks like it is part of the environment. Its unique design breaks up the human silhouette completely, thereby enhancing its effectiveness as a method of concealment. The outfit is insect-proof and can be treated with a water repellent spray to make it suitable for light rain conditions. The burlap strips 20 may also be attached to a firearm, bow or tree stand to further aid in camouflaging. The improved camouflage system 10 can be used for spring gobbler and fall turkey hunting as well as bow hunting, and slow stalking of game, as it allows the hunter to get closer to the animal. The system 10 also shows excellent potential as a suit for any paint ball war game uses.

| LIST OF REFERENCE NUMBERS | |
|---|---|
| 10 | improved camouflage system |
| 12 | garment |
| 14 | camouflage structure |
| 16 | attaching mechanism |
| 18 | terrain environment |
| 20 | burlap strip |
| 22 | serging stitch |
| 24 | individual strand |
| 26 | colored dye |
| 28 | hat for 12 |
| 30 | stitching between 20 and 28 |
| 32 | shirt for 12 |
| 34 | pants for 12 |
| 36 | female smap fastener |
| 38 | top end of 20 |
| 40 | straight stitch |
| 42 | male snap fastener |
| 44 | fold portion of 20 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved camouflage system which comprises:
a) a garment worn by a person;
b) means for producing an effective camouflage including a plurality of burlap strips, each of said plurality of burlap strips being comprised of individual strands of material, each burlap strip being sewn vertically down a center of the strip with a serging stitch, the individual strands of each burlap strip being frayed until they nearly meet said serging stitch; and
c) means for attaching said camouflage means in slightly overlapping rows to said garment for concealment of a body part of a person wearing said garment which will create an illusion of trees, shrubs and other foliage in a three dimensional effect to blend into a terrain environment.

2. An improved camouflage system as recited in claim 1, wherein each said burlap strip is dyed to various shades of woodland colors, so as to blend into woodland and grassy type environments.

3. An improved camouflage system as recited in claim 2, wherein each said burlap strip is wrung out by hand and allowed to air dry, so that the result is a stringy, fuzzy appearance for said burlap strip which resembles Spanish moss.

4. An improved camouflage system as recited in claim 3, wherein said garment is a hat worn on the head of the person.

5. An improved camouflage system as recited in claim 4, wherein said attaching means includes stitching at the top of each said burlap strip, so that said burlap strips can be sewn directly onto said hat.

6. An improved camouflage system as recited in claim 3, wherein said garment is a shirt and pants worn on the body of the person.

7. An improved camouflage system as recited in claim 6, wherein said attaching means includes:
a) said shirt and pants having a plurality of random placed female snap fasteners attached thereto;
b) each said burlap strip folded over at a top end and sewn in place with a straight stitch for added strength; and
c) a pair of spaced male snap fasteners attached to the inside fold portion of said burlap strip, so as to be removably affixed to two of said female snap fasteners on said shirt and pants for allowing the person to change the color of said burlap strips to accommodate seasonal and terrain changes, while also allowing the person to remove said burlap strips, so that said shirt and pants can be washed without damaging said burlap strips.

* * * * *